US010245468B2

(12) United States Patent
Hwang et al.

(10) Patent No.: US 10,245,468 B2
(45) Date of Patent: Apr. 2, 2019

(54) METHOD OF DIVIDING SPHERICAL SURFACE OF GOLF BALL, AND GOLF BALL HAVING SURFACE DIVIDED BY METHOD

(71) Applicant: VOLVIK INC., Chungcheongbuk-do (KR)

(72) Inventors: In Hong Hwang, Gyeonggi-do (KR); Kyung Ahn Moon, Seoul (KR)

(73) Assignee: VOLVIK INC., Chungcheongbuk-do (KR)

( * ) Notice: Subject to any disclaimer, the term of this patent is extended or adjusted under 35 U.S.C. 154(b) by 0 days.

(21) Appl. No.: 15/937,091

(22) Filed: Mar. 27, 2018

(65) Prior Publication Data

US 2018/0345084 A1 Dec. 6, 2018

(30) Foreign Application Priority Data

Jun. 5, 2017 (KR) ..... 10-2017-0069769

(51) Int. Cl.
*A63B 37/06* (2006.01)
*A63B 37/00* (2006.01)

(52) U.S. Cl.
CPC ..... *A63B 37/0006* (2013.01); *A63B 37/0009* (2013.01); *A63B 37/0017* (2013.01)

(58) Field of Classification Search
CPC ..... A63B 37/0006
USPC ..... 473/378
See application file for complete search history.

(56) References Cited

U.S. PATENT DOCUMENTS 5,564,708 A 10/1996 Hwang
6,358,161 B1 3/2002 Aoyama
6,450,902 B1 9/2002 Hwang
6,908,403 B1 * 6/2005 Hwang ..... A63B 37/0003 473/383
2001/0027141 A1 10/2001 Sajima

FOREIGN PATENT DOCUMENTS

KR 100182100 B1 5/1999
KR 101633869 B1 6/2016

OTHER PUBLICATIONS

Office Action corresponding to KR 10-2017-0069769, dated Oct. 30, 2017, two pages.

* cited by examiner

*Primary Examiner* — Raeann Gorden
(74) *Attorney, Agent, or Firm* — Kilpatrick Townsend & Stockton LLP

(57) ABSTRACT

In a golf ball, dimples are arranged on a spherical polyhedron formed by dividing a surface of a sphere using small circles and great circles only on the equator, without arranging the dimples on a spherical polyhedron formed by dividing a surface of a sphere using great circles. The formed spherical polyhedron includes two spherical regular hexagons centered on a pole, twelve near-pole spherical isosceles triangles, twelve near-equator spherical pentagons, and twelve near-equator spherical isosceles triangles, in which the dimples are arranged. Thus, a dimple area ratio may be improved by 2 to 4%, compared to the prior art in which dimples are arranged in spherical polygons of a cubeoctahedron (or an octahedron) divided by great circles.

18 Claims, 8 Drawing Sheets

Dimple Diameter

| | |
|---|---|
| A = 0.1825" ~ 0.1775" | B = 0.1725" ~ 0.1675" |
| C = 0.1625" ~ 0.1575" | D = 0.1475" ~ 0.1425" |
| E = 0.1425" ~ 0.1375" | F = 0.1125" ~ 0.1075" |

A > B > C > D > E > F

METHOD OF DIVIDING SPHERICAL SURFACE OF GOLF BALL, AND GOLF BALL HAVING SURFACE DIVIDED BY METHOD

CROSS-REFERENCE TO RELATED APPLICATION

This application claims the benefit of Korean Patent Application No. 10-2017-0069769, filed on Jun. 5, 2017, in the Korean Intellectual Property Office, the disclosure of which is incorporated herein in its entirety by reference.

BACKGROUND

1. Field

One or more embodiments relate to a method of dividing a spherical surface of a golf ball to arrange dimples on a surface of the golf ball, and a golf ball having a surface divided by the method.

2. Description of the Related Art

In order to arrange dimples on a surface of a golf ball, a surface of a sphere is generally divided by great circles into a spherical polyhedron having a plurality of spherical polygons.

The dimples are arranged in the spherical polygons divided as above in such a manner that the dimples have a symmetry. A great circle denotes a circle having the largest diameter, such as the equator, among circles on a spherical surface. In contrast, a small circle denotes a circle having a smaller diameter than the great circle, the small circle being on the spherical surface. Most spherical polyhedrons having a spherical surface divided by great circles include spherical regular polygons. Examples of the spherical polyhedrons frequently used to arrange dimples of a golf ball may include a spherical tetrahedron having four spherical regular triangles, a spherical hexahedron having six spherical squares, a spherical octahedron having eight spherical regular triangles, a spherical dodecahedron having twelve regular pentagons, a spherical icosahedron having twenty spherical regular triangles, a spherical cubeoctahedron having six spherical squares and eight spherical regular triangles, an icosidodecahedron having twenty spherical regular triangles and twelve spherical regular pentagons, or the like.

U.S. Pat. No. 5,564,708 discloses a golf ball having dimples of various sizes in a spherical octahedron and a spherical cubeoctahedron formed by dividing a sphere by great circles. Six identical dimples are circularly arranged around a center of each of spherical regular triangles constituting a spherical cubeoctahedron. The present patent also discloses the sizes of dimples, an arrangement method, etc.

U.S. Pat. No. 6,358,161 discloses a golf ball having a plurality of dimples and arranged in a triangular area in a regular spherical icosahedron or a regular spherical octahedron. The present patent relates to a method of arranging dimples such that the diameter of a dimple is greater than or equal to 0.11 inches and a dimple area ratio indicating a ratio of an area occupied by dimples with respect to the entire surface area of a sphere is 80% or more.

U.S. Pat. No. 6,450,902 discloses the arrangement of dimples of a golf ball in which dimples in some areas of polygons formed by dividing a surface of a sphere by great circles are larger by 10% or more than dimples in a large spherical triangle at a central portion, by which air flow is facilitated and thus a flight distance is increased.

U.S. Patent Publication No. 2001/0027141A1 discloses a golf ball in which dimples are arranged such that, when one of line segments connecting middle points of sides of each spherical triangle of a spherical octahedron formed by dividing a surface of a sphere by three great lines is set to be the equator, some dimples are located such that they do not contact the equator line and some dimples are located across the equator. In this state, none of the dimples have a half that intersects the equator and some of the dimples have a half that intersects other dividing lines.

U.S. Pat. No. 6,908,403 discloses dimples of a golf ball in which a new spherical polyhedron is formed by dividing a surface of a sphere by great circles and dimples are symmetrically arranged in each face, particularly, relatively large dimples having a diameter of about 0.19 to 0.20 inches are symmetrically arranged at three vertex portions of each spherical triangle and four vertex portions of each spherical octagon.

SUMMARY

When dimples are symmetrically arranged by limiting the number of dimples to be about 270 to 390 in a spherical polyhedron including spherical regular polygons formed by dividing a surface of a sphere by great circles, in order to decrease the number of diameter sizes of dimples of a certain size or more to 2 to 6 sizes by making the diameter size of the dimples similar to each other when a mold cavity for the dimples is manufactured, a land surface in which no dimple exists necessarily increases. Accordingly, in order to decrease the land area, various types of dimples having very small diameters are created to fill gaps between relatively large dimples. Since the number of dimple types according to the size thereof generally increases, costs for manufacturing a mold cavity increase, an overall dimple area ratio of a manufactured golf ball decreases, and aesthetic sense may deteriorate.

In some cases, in a spherical polyhedron formed of two or more types of spherical regular polygons, the diameter size of a dimple varies according to the type of aspherical regular polygon, and thus a difference in the flow of air affecting flight performance partially increases. This phenomenon is generated because there is a limit in the area occupied by large dimples according to the size of spherical regular polygons formed by dividing a surface of a sphere, to conform to symmetry that is already set according to the regulations of the R & A and the U.S.G.A. regarding use of a golf ball as an official ball. In this case, however, if the dimples are arbitrarily placed overlapping each other, flight characteristics may vary and thus a problem may occur with respect to symmetry. As a result, neighboring dimples should have an allowable edge (an edge portion of a dimple) therebetween, even if it is very small.

Furthermore, while dimples adjacent to both sides of the boundary of a dividing line intersect the dividing line to some extent, as the mold is divided into the northern hemisphere and the southern hemisphere, it is inevitably difficult to select locations of the dimples on both the upper and lower sides of a mold parting line. In addition to this, a dimple-shaped vent pin centered on the pole is formed to extract various gaseous materials generated during a molding operation. Depending on the size of the vent pin, the size of the dimples around the vent pin is restricted, and when the size of the dimples increases 0.145 inches or more, a land surface (a surface on which the dimples do not exist)

according to the arrangement of the dimples in the polygons around the pole has to be formed larger than the others.

Furthermore, in the divided spherical polygons, the number and size of the dimples are restricted depending on the sizes of the divided spherical polygons, and thus many empty spaces without the dimples, that is, land surface portions, may be formed. In such a case, dimples of a small size may be forcibly filled to reduce the land surface. This is because, for the same golf ball, there is a difference in lift according to the dimple area ratio. Thus, filling small dimples is unavoidable, in order to increase lift.

Additional aspects will be set forth in part in the description which follows and, in part, will be apparent from the description, or may be learned by practice of the presented embodiments.

The present inventive concept is provided to address the above-mentioned problems caused by arranging dimples on a spherical polyhedron having a predetermined size and including spherical regular polygons formed by dividing a surface of a sphere using great circles according to the related art, and to obtain an arrangement of dimples which may easily form symmetry, in particular, to reduce the land surface without dimples and increase the dimple area ratio.

Instead of the great circles used to divide the surface of a general sphere, in the present inventive concept, symmetric spherical polygons are created by dividing the surface of a sphere with small circles, and the dimples are arranged in the spherical polygons in a symmetrical manner.

The spherical polygons divided by the dividing method according to the present inventive concept include two spherical regular hexagons, twelve spherical isosceles triangles, another twelve spherical isosceles triangles, and twelve spherical pentagons.

BRIEF DESCRIPTION OF THE DRAWINGS

These and/or other aspects will become apparent and more readily appreciated from the following description of the embodiments, taken in conjunction with the accompanying drawings in which.

DETAILED DESCRIPTION

Figure 1:
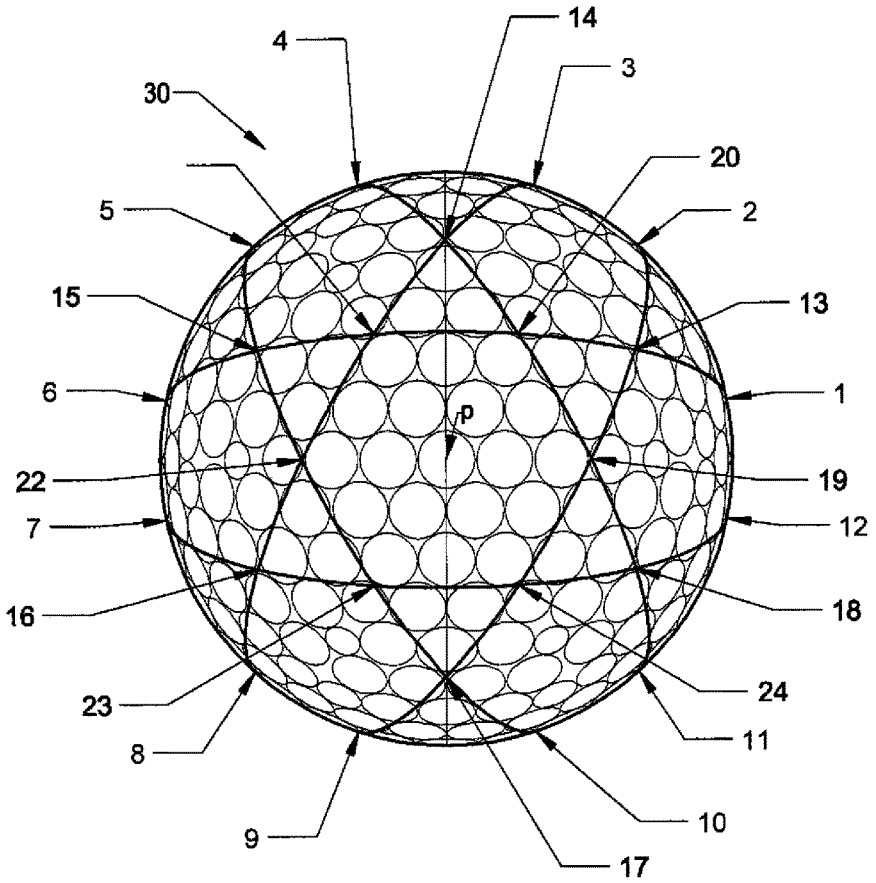
FIG. 1 is a diagram of a golf ball having a surface on which dimples are arranged, viewed from a pole side of the golf ball, according to an embodiment, which illustrates the latitudes and longitudes of major locations where small circles dividing a surface of a sphere and one great circle forming the equator intersect, spherical polygons formed on a surface of the sphere divided by the small circles and the great circle forming the equator, and dimples symmetrically arranged in the spherical polygons, in which a land surface appears to be smaller than the land surface formed on a surface of a golf ball of the prior art divided by great circles.

Reference will now be made in detail to embodiments, examples of which are illustrated in the accompanying drawings, wherein like reference numerals refer to like elements throughout. In this regard, the present embodiments may have different forms and should not be construed as being limited to the descriptions set forth herein. Accordingly, the embodiments are merely described below, by referring to the figures, to explain aspects of the present description. As used herein, the term "and/or" includes any and all combinations of one or more of the associated listed items. Expressions such as "at least one of," when preceding a list of elements, modify the entire list of elements and do not modify the individual elements of the list.

Since it is difficult to proportionally arrange dimples of a small type and having similar diameters with the set sizes of a spherical regular triangle and a spherical square of an existing spherical cubeoctahedron formed by dividing a surface of a sphere using great circles, the size of each spherical polygon needs to be adjusted. Thus, it is inevitable to search for a method of making symmetry by dividing a sphere using small circles instead of the great circles. In the present embodiment, in the northern hemisphere of a sphere, a surface of a sphere is divided by the small circles and then dimples are arranged thereon, and the southern hemisphere opposite to the northern hemisphere is rotated counterclockwise by 30° with respect to the north pole and the south pole, and dimples are symmetrically arranged in each of spherical polygons formed by dividing the surface of the sphere in the same manner as the northern hemisphere, for completion. In the present specification, only the northern hemisphere is discussed.

Figure 2:
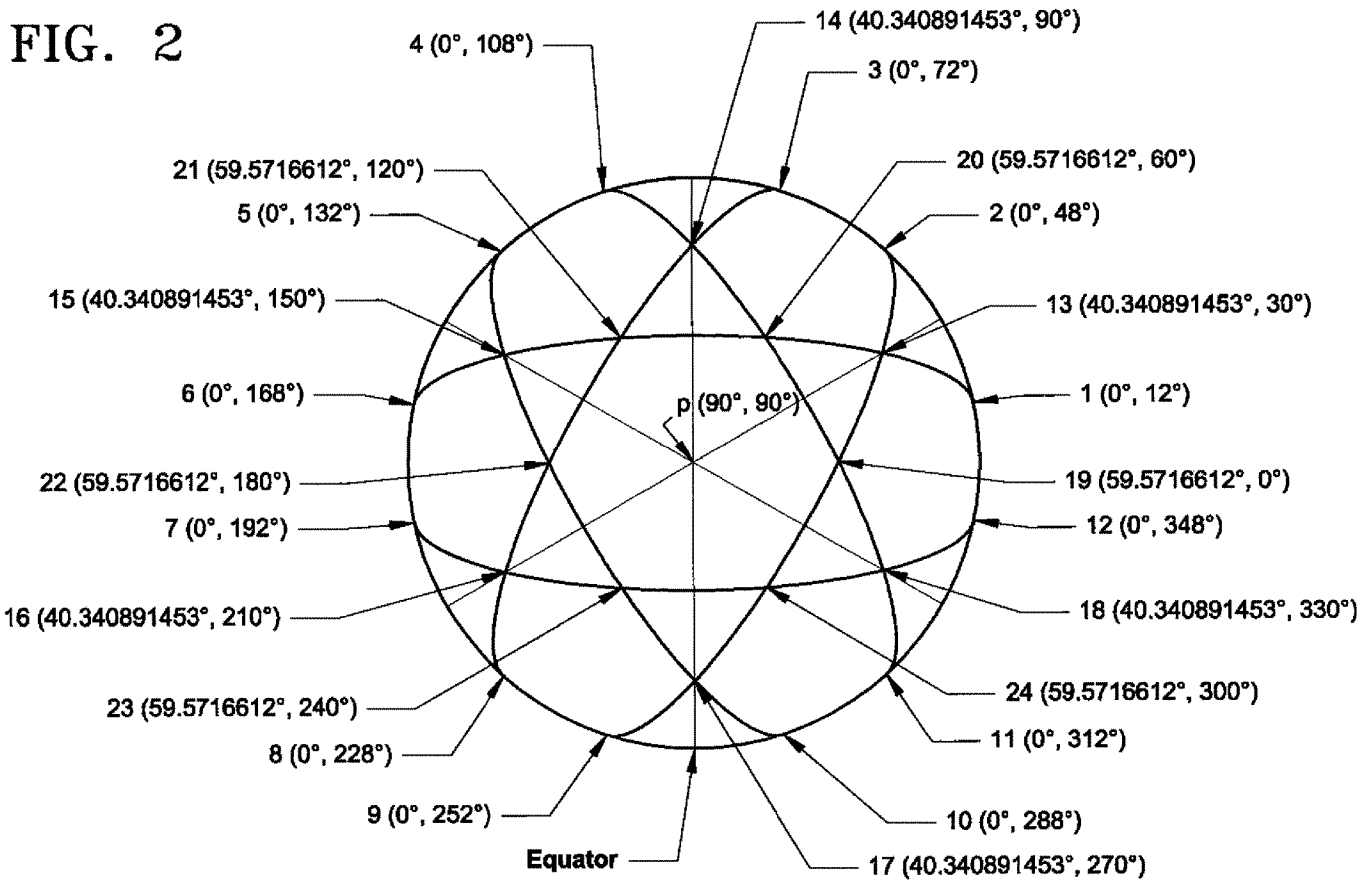
FIG. 2 illustrates the latitudes and longitudes of locations which parting lines (thick solid lines) formed by the small circles and one great circle pass through, on the surface of the sphere, according to an embodiment.

Referring to FIG. 2, a surface of a sphere is divided by a small circle line segment passing through Point 1 (latitude 0°, longitude 12°), Point 13 (latitude 40.340891453°, longitude 30°), Point 20 (latitude 59.5716612°, longitude 60°), Point 21 (latitude 59.5716612°, longitude 120°), Point 15 (latitude 40.340891453°, longitude) 150°, and Point 6 (latitude 0°, longitude 168°); the surface of the sphere is divided again by a small circle line segment passing through Point 2 (latitude 0°, longitude 48°), Point 13 (latitude 40.340891453°, longitude 30°), Point 19 (latitude 59.5716612°, longitude 0°), Point 24 (latitude 59.5716612°, longitude 300°), Point 17 (latitude 40.340891453°, longitude 270°), and Point 9 (latitude 0°, longitude 252°); the surface of the sphere is divided again by a small circle line segment passing through Point 3 (latitude 0°, longitude 72°), Point 14 (latitude 40.340891453°, longitude 90°), Point 21 (latitude 59.5716612°, longitude 120°), Point 22 (latitude 59.5716612°, longitude 180°), Point 16 (latitude 40.340891453°, longitude 210°), and Point 8 (latitude 0°, longitude) 228°; the surface of the sphere is divided again by a small circle line segment passing through Point 4 (latitude 0°, longitude 108°), Point 14 (latitude 40.340891453°, longitude) 90°, Point 20 (latitude 59.5716612°, longitude 60°), Point 19 (latitude 59.5716612°, longitude 0°), Point 18 (latitude 40.340891453°, longitude 330°), and Point 11 (latitude 0°, longitude 312°); the surface of the sphere is divided again by a small circle line segment passing through Point 5 (latitude 0°, longitude 132°), Point 15 (latitude 40.340891453°, longitude 150°), Point 22 (latitude 59.5716612°, longitude 180°), Point 23 (latitude 59.5716612°, longitude 240°), Point 17 (latitude 40.340891453°, longitude 270°), and Point 10 (latitude 0°, longitude 288°); the surface of the sphere is divided again by a small circle line segment passing through Point 7 (latitude 0°, longitude 192°), Point 16 (latitude 40.340891453°, longitude 210°), Point 23 (latitude 59.5716612°, longitude 240°), Point 24 (latitude 59.5716612°, longitude 300°), Point 18 (latitude 40.340891453°, longitude 330°), and Point 12 (latitude 0°, longitude 348°); and the surface of the sphere is divided again by a line segment connecting Point 1 (latitude 0°, longitude 12°), Point 3 (latitude 0°, longitude 72°), Point 5 (latitude 0°, longitude 132°), Point 7 (latitude 0°, longitude 192°), Point 9 (latitude 0°, longitude 252°), Point 11 (latitude 0°, longitude 312°), and Point 1 (latitude 0°, longitude 12°) (this connection line corresponds to the circumference of the sphere and is the great circle of the sphere) which is used as the equator Eq.

A golf ball 30 is formed by arranging dimples on the spherical polygons formed as above. As the spherical polygon formed by the small circle line segments and the great circle of the equator illustrated in FIG. 2 can be expressed, in FIG. 3, by the size of each interior angle of major spherical polygons for arranging dimples according to the present embodiment, the location of each vertex of the spherical polygon, and the size of a side of the spherical polygon, which is indicated by an angular distance, and thus the sizes and number of dimples may be easily determined.

Figure 3:
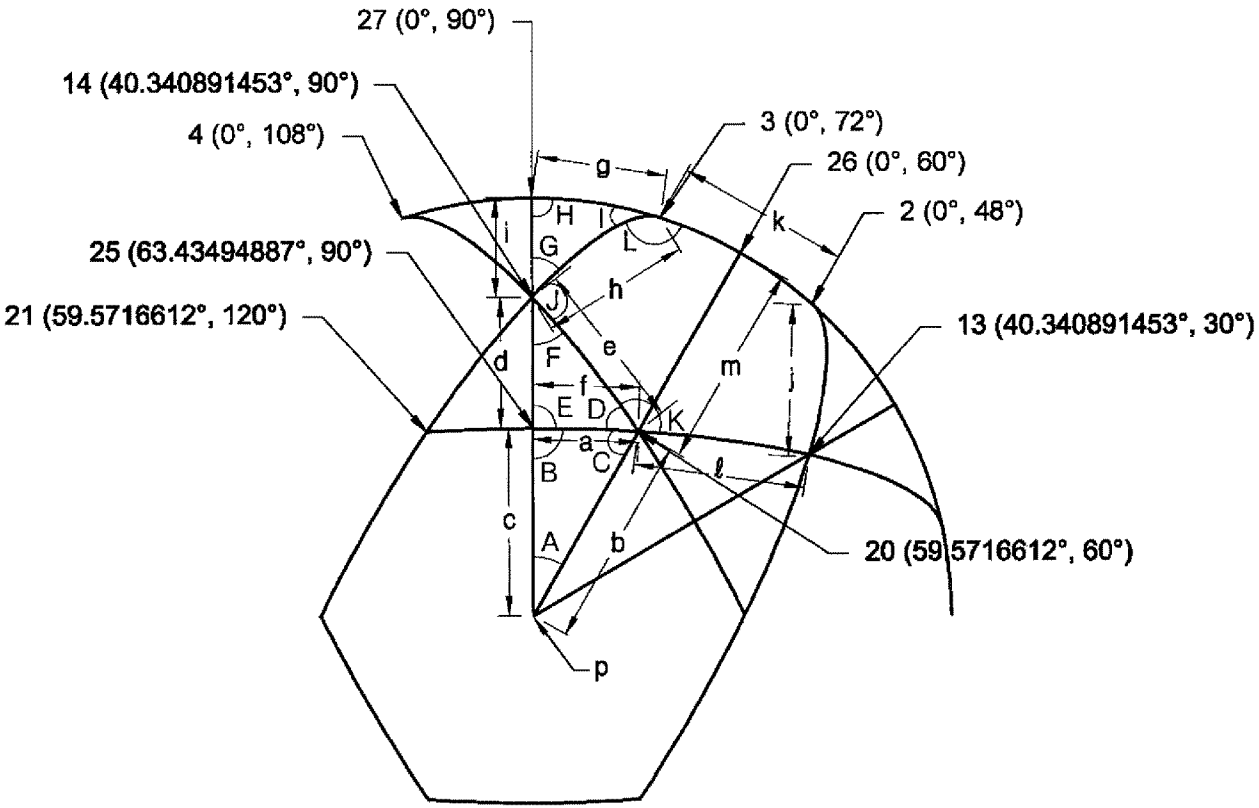
FIG. 3 illustrates the latitudes and longitudes of locations of vertices of representative ones among the respective spherical polygons symmetrically provided to arrange dimples on the surface of the sphere divided according to the present embodiment, in which, to indicate sizes of the formed spherical polygons, an interior angle of each vertex of a representative spherical polygon among the spherical polygons and a length of each side facing the vertex corresponding thereto are provided so that an angular distance at each position may be calculated.
Figure 4:
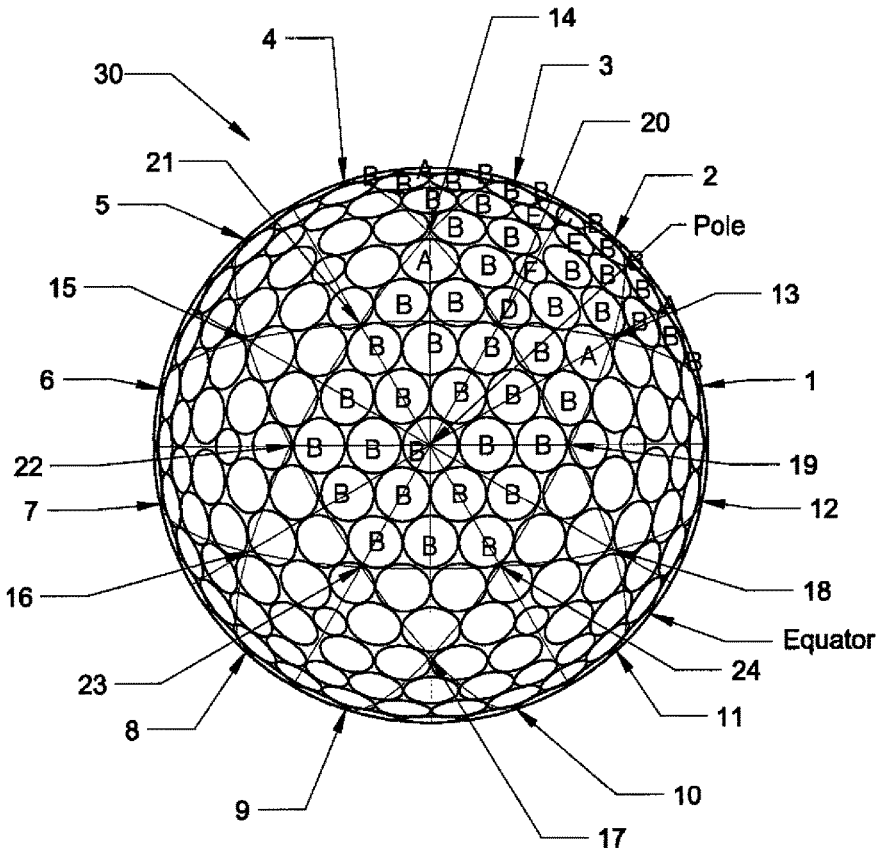
FIG. 4 illustrates an example in which dimples are arranged, by sizes thereof, in the spherical polygons formed on the surface of the sphere according to the present embodiment, in which dimples of the same size are arranged, without the land surface, in a spherical polygon centered on the pole.

FIG. 3 illustrates the size of a spherical regular hexagon having a center at the pole and using line segments connecting Point 19 (latitude 59.5716612°, longitude 0°), Point 20 (latitude 59.5716612°, longitude 60°), Point 21 (latitude 59.5716612°, longitude 120°), Point 22 (latitude 59.5716612°, longitude 180°), Point 23 (latitude 59.5716612°, longitude 240°), and Point 24 (latitude 59.5716612°, longitude 300°) formed around the pole by using the small circle line segments in FIG. 2, as sides. An interior angle 2C of one vertex of the spherical regular hexagon is 126.8698976°. Also, when the circumference of the sphere is 360°, a length 2*a* of one side is 29.33747736° angular distance. A distance connecting middle points of opposing sides of the spherical pentagon, that is, a distance 2*c*, is 53.13010226° angular distance when the circumference of the sphere is 360°. Also, a distance connecting opposing vertices of the spherical pentagon, that is, a distance 2*b*, is 60.8566776° angular distance when the circumference of the sphere is 360°. Two spherical regular hexagons configured as above are formed with respect to the North Pole and the South Pole.

FIG. 3 illustrates one spherical isosceles triangle located near the pole and sharing one side with the spherical regular hexagon having a center at the pole. The near-pole spherical isosceles triangle is formed by using line segments connecting Point 20 (latitude 59.5716612°, longitude 60°), Point 14 (latitude 40.340891453°, longitude 90°, and Point 21 (latitude 59.5716612°, longitude 120°), as sides. In the near-pole spherical isosceles triangle, an interior angle D of a vertex is 60.37233171° angular distance and the opposing interior angles are the same. An interior angle 2F of another vertex is 68.27619059°. Also, when the circumference of the sphere is 360°, since the length of one side near the pole is the same as the length of one side of the near-pole spherical regular hexagon, the length of the near-pole side is 29.33747736° (2*f*=2*a*) and a length e of each of two equal sides is 26.81321993° angular distance when the circumference of the sphere is 360°. A height d of the spherical isosceles triangle, that is, a line segment connecting a vertex of the spherical isosceles triangle, which is Point 14 (latitude 40.340891453°, longitude 90°), and a middle point of a side facing the vertex, which is Point 25 (latitude 63.43494887°, longitude 90°), is 23.09405742° angular distance when the circumference of the sphere is 360°. A total of twelve near-pole spherical isosceles triangles configured as above are formed including six in the northern hemisphere and six in the southern hemisphere.

One of spherical pentagons sharing one vertex of the spherical regular hexagon of FIG. 3, sharing one side each with the two near-pole spherical isosceles triangles, and having one side on the equator is formed by line segments connecting Point 20 (latitude 59.5716612°, longitude 60°), Point 14 (latitude 40.340891453°, longitude 90°), Point 3 (latitude 0°, longitude 72°), Point 2 (latitude 0°, longitude 48°), and Point 13 (latitude 40.340891453°, longitude 30°). In the spherical pentagon configured as above, an interior angle K of a vertex facing the equator is 112.385439°, an interior angle J of a vertex at Point 14 (latitude 40.340891453°, longitude 90°) is 119.2082182°, which is the same as the interior angle of a vertex at Point 13 (latitude 40.340891453°, longitude 30°). An interior angle L of a vertex at Point 3 (latitude 0° and longitude 72°) contacting the equator is 109.9940982°, which is the same as an interior angle of a vertex at Point 2 (latitude 0° and longitude 48°) contacting the equator. When the circumference of the sphere is 360°, the length of each of two sides near the pole of the spherical pentagon is 26.81321993° angular distance, which is the same length of a side e of the near-pole spherical isosceles triangle. The length h of a line segment, which is another side of the spherical pentagon, connecting Point 14 (latitude 40.340891453°, longitude 90°) and Point 3 (latitude 0°, longitude 72°) contacting the equator is 43.53934684° angular distance. Also, the length j of another side connecting Point 13 (latitude 40.340891453°, longitude 30°) and Point 2 (latitude 0°, longitude 48°) is identically 43.53934684° angular distance. When a line segment perpendicularly connecting from an equator line segment of the near-equator spherical pentagon to Point 26 (latitude 0°, longitude 60°) is set to be the height of the near-equator spherical pentagon, a height m is 59.5716612° angular distance when the circumference of the sphere is 360°. Also, when a line segment connecting from Point 2 (latitude 0°, longitude 48°) of the near-equator spherical pentagon to Point 3 (latitude 0°, longitude 72°) along the equator line segment is set to be a base of the near-equator spherical pentagon, a base k is 24° angular distance when the circumference of the sphere is 360°.

A total of twelve near-equator spherical pentagons configured as above, including six in the northern hemisphere and six in the southern hemisphere, are formed.

FIG. 3 illustrates one of the near-equator spherical triangles sharing one side with the near-equator spherical pentagon. In a spherical triangle having line segments connecting Point 14 (latitude 40.340891453°, longitude 90°), Point 4 (latitude 0°, longitude 108°), and Point 3 (latitude 0°, longitude 72°), as sides, an interior angle 2G of a vertex at Point 14 is 53.307373°, an interior angle I of a vertex at Point 3 is 70.0059018°, and the size of an interior angle of a vertex at Point 4 is the same as the interior angle I. The length of one side h of the near-equator spherical triangle connecting Point 14 and Point 3 of FIG. 3 is 43.53934684° angular distance when the circumference of the sphere is 360°. The length of a side connecting Point 14 and Point 4 is identically 43.53934684° angular distance. A length 2*g* of a line segment between Point 3 and Point 4, that is, the side of the near-equator spherical triangle contacting the equator, as a part of the equator line segment, is 36° angular distance. When a line segment perpendicularly connecting the vertex at Point 14 of the near-equator spherical triangle and Point 27 (latitude 0°, longitude 90°) on the equator is set to be the height of the near-equator spherical triangle, a height i is 40.34089145° angular distance when the circumference of the sphere is 360°. A total of twelve near-equator spherical triangles configured as above, including six in the northern hemisphere and six in the southern hemisphere, are formed. It is the characteristic of the present embodiment that an area ratio of the area of dimples to the entire surface area of a golf ball is 2 to 4% higher than that of the existing spherical polyhedron divided by the great circle. An area of the spherical hexagon centered on the pole among the spherical polygons formed according to the division scheme according to the present embodiment takes 11.44983% of the entire surface of the sphere. An area ratio of the dimples existing in the spherical hexagon takes 11 to 12% to the area taken by all dimples on the entire surface of the sphere. Accordingly, the division scheme of a dimple arrangement according to the present embodiment may increase the lift compared to the existing division scheme. In the spherical hexagon, since dimples having the same size over a certain size are arranged almost without a land surface so that superior dimple arrangement may be obtained.

Figure 5:
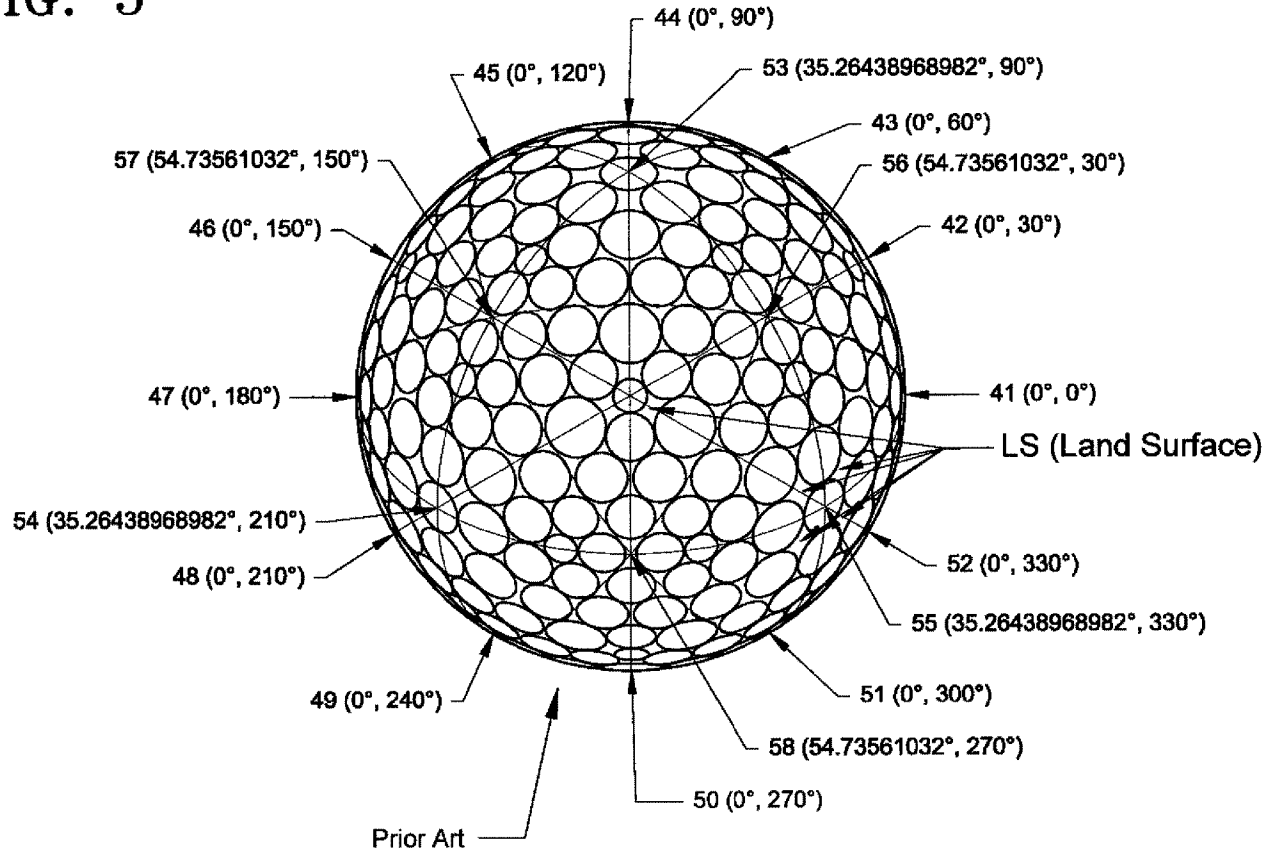
FIG. 5 illustrates a comparative example, in which a surface of a sphere is divided by great circles, as in the prior art, thereby forming a spherical cubeoctahedron (or a spherical octahedron) with dimples arranged thereon, showing the latitudes and longitudes of locations which the great circles pass through and a land surface LS formed with a relatively large area.
Figure 7:
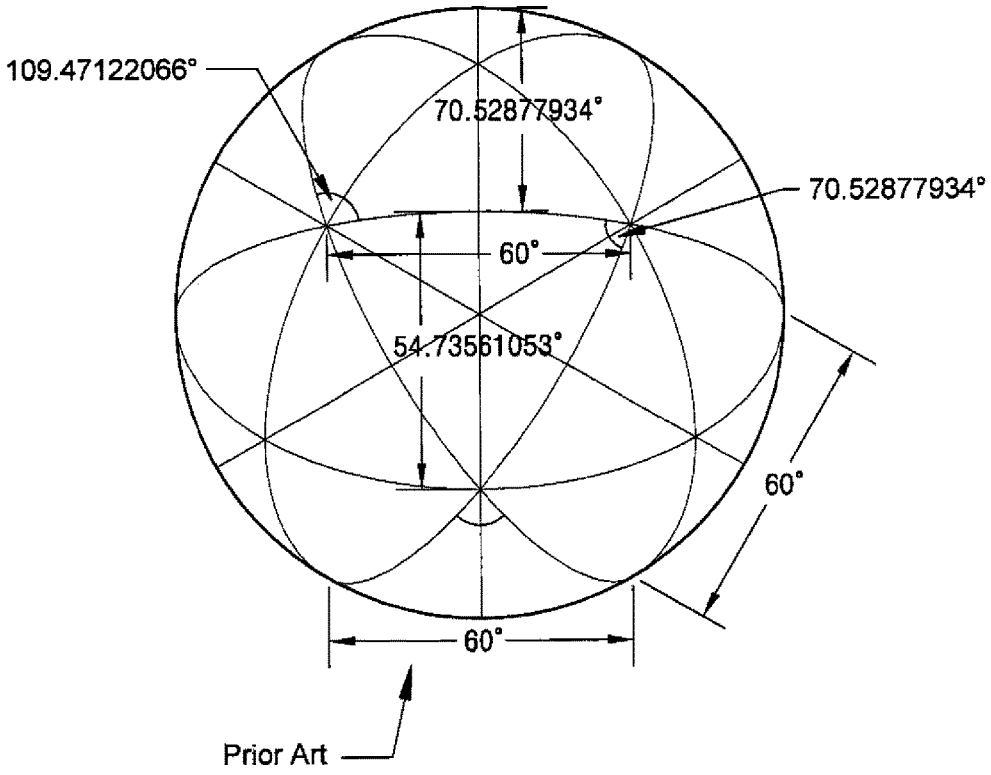
FIG. 7 illustrates the representative interior angles and lengths, showing that eight spherical regular triangles have the same interior angle and length and six spherical regular squares have the same interior angle and length in the spherical cubeoctahedron that is formed by dividing the surface of the sphere by the great circles forming the comparative example of the prior art of FIG. 5.

FIG. 5 illustrates, as a comparative example, that dimples are arranged on an spherical cubeoctahedron (or an spherical octahedron) obtained by dividing a surface of a sphere using great circles, as in the prior art. The surface of the sphere is divided by a great circle line segment passing through Point 41 (latitude 0°, longitude 0°), Point 56 (latitude 54.73561032°, longitude 30°), Point 57 (latitude 54.73561032°, longitude 150°), and Point 47 (latitude 0°, longitude 180°), by a great circle line segment passing through Point 43 (latitude 0°, longitude 60°), Point 56 (latitude 54.73561032°, longitude 30°), Point 58 (latitude 54.73561032°, longitude 270°), and Point 49 (latitude 0°, longitude) 240°, and by a great circle line segment passing through Point 45 (latitude 0°, longitude) 120°, Point 57 (latitude 54.73561032°, longitude 150°), Point 58 (latitude 54.73561032°, longitude 270°), and Point 51 (latitude 0°, longitude 300°). A great circle line segment passing through Point 41 (latitude 0°, longitude 0°), Point 44 (latitude 0°, longitude 90°), Point 47 (latitude 0°, longitude 180°), and Point 50 (latitude 0°, longitude 270°) is used as the equator Eq. FIGS. 5 and 7 illustrate forming of an spherical cubeoctahedron of the prior art by dividing a surface of a sphere using the great circles as described above. In FIG. 7, the sizes of all eight spherical regular triangles are identical regardless of whether it is a near-pole spherical regular triangle or a near-equator spherical regular triangle. The interior angle of one vertex of the spherical regular triangle is 70.52877934° and the length of one side of the spherical regular triangle is 60° angular distance when the circumference of the sphere is 360°. All eight spherical regular triangles have the same side length. The height of the spherical regular triangle is 54.73561053° angular distance and all spherical regular triangles have the same height length.

FIG. 7 illustrates that the sizes of the six spherical squares formed by the great circles are the same, and the interior angle of one vertex is 109.47122066° and thus all six spherical squares have the same interior angle. Also, the length of one side of each of the spherical squares is 60° angular distance, when the circumference of the sphere is 360°, and all six spherical squares have the same side length and share a side of the same length with an adjacent spherical triangle. In FIG. 7, the length of a height connecting a middle point of one side of a spherical square and a middle point of an opposing side thereof is 70.52877934 angular distance, when the circumference of the sphere is 360°, and all six spherical squares have the same height length. As such, when dimples are arranged on the spherical cubeoctahedron formed by dividing a surface of a sphere using the great circles, as illustrated in FIG. 5, a large land surface LS is formed as illustrated so that the dimple area ratio may decrease enough to affect the lift.

Figure 6:
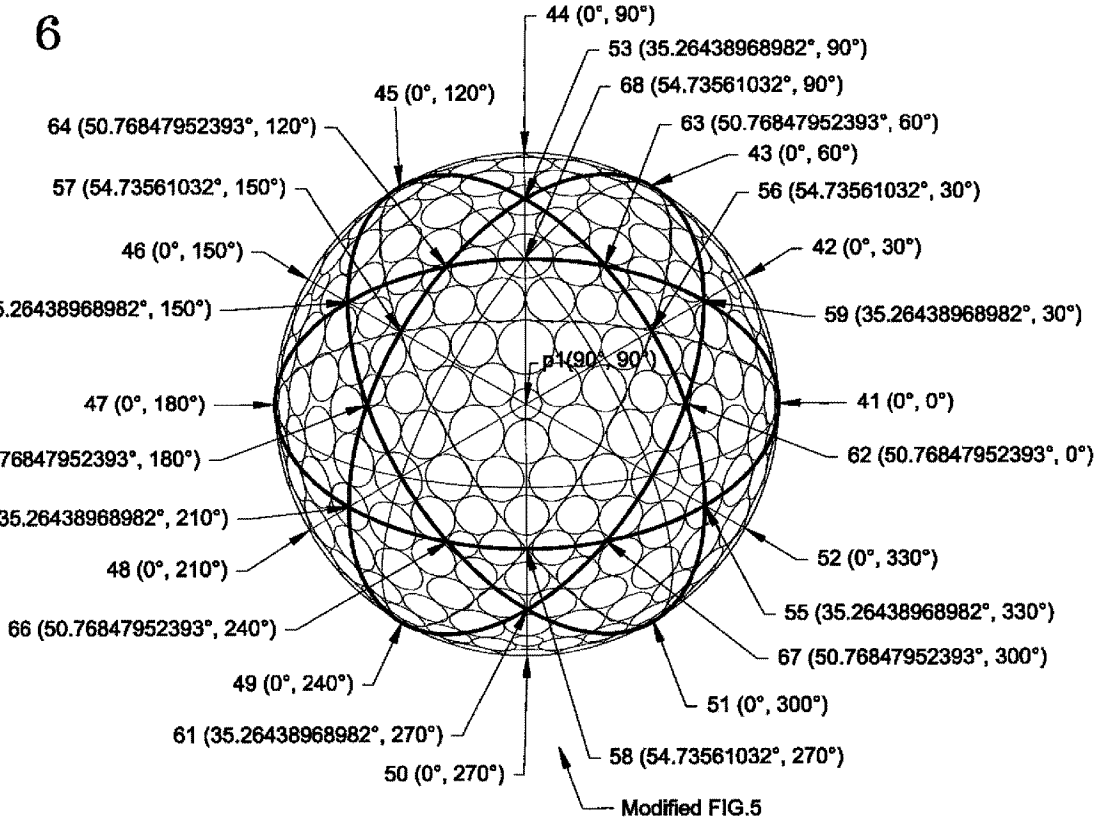
FIG. 6 illustrates a composite division scheme of a division scheme obtained by rotating the spherical cubeoctahedron having the dimple arrangement structure of the prior art in FIG. 5, by 60°, around the pole, and the division scheme of FIG. 5, which is reconfigured to have a shape similar to the spherical polygons according to the present embodiment (indicated by thick solid lines), in which a spherical regular hexagon including the pole, spherical isosceles triangles near the pole, spherical *rhombi* each having two pairs of the same sides, other spherical isosceles triangles near the equator, etc. are formed, for comparison with the present embodiment.

FIG. 6 shows a comparative example and is created by reconfiguring FIG. 5 in which dimples are arranged on the spherical cubeoctahedron of the prior art to have the shape of spherical polygons having similar structure as FIG. 1 in which dimples are arranged by dividing a surface of a sphere according to the present embodiment. Although FIG. 6 illustrates only the northern hemisphere, the entire golf ball include two spherical regular hexagons, twelve near-pole spherical isosceles triangles, other twelve near-equator spherical isosceles triangles equator, and twelve spherical *rhombi* each having two pairs of the same sides. The spherical rhombus having two pairs of the same sides is quite different from the spherical pentagon having five sides formed by the division scheme according to the present embodiment. Furthermore, in the comparative example of FIG. 6, dimples are not accurately arranged according to the division, and though the sizes of spherical polygons of the comparative example of FIG. 6 correspond to the sizes of the present invention, it is difficult to to decrease the land surface LS and increase the lift.

Since the arrangement of dimples in FIG. 1 according to the present embodiment generates a quite small land surface LS than that in FIG. 5 or 6 which is presented as the comparative example, a golf ball having a dimple area ratio that is increased by 2 to 4% compared to the dimple arrangement of the prior art in which dimples are arranged by dividing a surface of a sphere using the great circles only, may be formed.

The above-described golf ball according to the present embodiment may be described again as follows.

The golf ball according to the present embodiment is manufacturing by basically dividing a surface of a sphere by virtual parting lines and arranging dimples in the formed virtual spherical polygons.

The golf ball according to the present embodiment may be manufactured by combining two hemispheres manufactured from one mold. In other words, a spherical body of the golf ball according to the present embodiment is divided by the equator into two hemispheres, each hemisphere being divided by the equator and six small circle line segments forming a plurality of spherical polygons, and dimples are arranged in the spherical polygons.

The small circle line segment on the hemisphere is shorter than the length of the equator, and six small circle line segments are symmetrically arranged to form a spherical regular hexagon centered on the pole that is the farthest location from equator.

The virtual spherical polygons formed on the hemisphere by the six small circle line segments and the equator may include one spherical regular hexagon centered on the pole, six middle spherical isosceles triangles having one side of the spherical regular hexagon as a base, six near-equator spherical isosceles triangles sharing the near-equator vertex of the middle spherical isosceles triangle and having the base on the equator, and six spherical pentagons located between the middle spherical isosceles triangles and the near-equator spherical isosceles triangles and having one side on the equator.

A golf ball is formed by combining the two hemispheres configured as above such that the equators thereof contact each other. When combining the hemispheres, instead of combining the hemispheres to be symmetrically with respect to the equator, the hemispheres are combined to each other by rotating one hemisphere by 30° to the other hemisphere with respect to a reference line passing through the poles of the two hemispheres and perpendicular to a plane where the equator is located. The small circle line segments on one hemisphere may be connected to the small circle line segments on the other hemisphere, forming smooth curves.

As such, when the hemispheres are combined to each other, the hemispheres are combined to be symmetrically to the reference line passing through both poles (a center axis of a sphere). Furthermore, since the dimple area ratio is increased, a flight distance of a golf ball may be increased.

Figure 8:
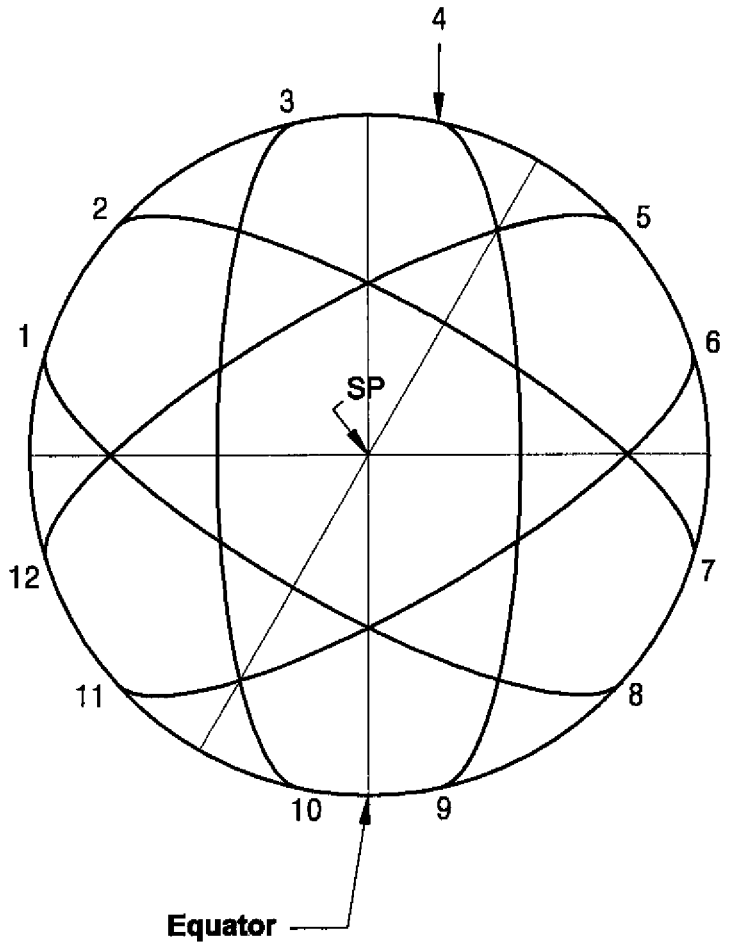
FIG. 8 illustrates the golf ball of FIG. 1, viewed from a back side of FIG. 1, in which indications of dimples are omitted.

While FIG. 1 illustrates the front side (a surface centered on the north pole P) of a golf ball, FIG. 8 illustrates the rear side (a surface centered on the south pole SP) of the golf ball, where the illustration of dimples is omitted.

When viewed from the small circle line segments of FIG. 1, the small circle line segments of FIG. 8 seem to be rotated by 30° clockwise around the pole. In this state, the golf ball according to the present embodiment may be manufactured by combining two hemispheres such that Points 1 to 12 of FIG. 1 and Points 1 to 12 of FIG. 8 may meet each other. In this case, the small circle line segments on the hemisphere at one side may be smoothly connected to the small circle line segments on the hemisphere at the other side. The smooth connection may signify that a connection point is not a bent line. In terms of mathematics, it means a case in which the left limited value and the right limit value are the same at the connection point of the curves.

As described above, since a land surface formed on the spherical polyhedron divided by a small circles according to the present embodiment is quite smaller than the large land surface formed on the spherical polyhedron of the prior art formed by dividing a surface of a sphere using the great circles, the dimple area ratio may increase by 2% to 4%, the flight distance may be improved due to the increased dimple area ratio. A mold cavity may be manufactured by using a less number of types, for example, 2 to 6 types, according to the diameter of a dimple. In particular, dimples having the same size over a certain level are arranged in a spherical hexagon around the pole with almost no land surface, and thus a superior aesthetic sense may be obtained and mold manufacturing costs may be saved.

It should be understood that embodiments described herein should be considered in a descriptive sense only and not for purposes of limitation. Descriptions of features or aspects within each embodiment should typically be considered as available for other similar features or aspects in other embodiments.

While one or more embodiments have been described with reference to the figures, it will be understood by those of ordinary skill in the art that various changes in form and details may be made therein without departing from the spirit and scope as defined by the following claims.

What is claimed is:

1. A golf ball having dimples arranged in spherical polygons, wherein, when an arbitrary point on a surface of a sphere is set to be a pole P, the spherical polygons are formed by dividing the surface of the sphere by a small circle line segment passing through Point 1 (latitude 0°, longitude 12°), Point 13 (latitude 40.340891453°, longitude 30°), Point 20 (latitude 59.5716612°, longitude 60°), Point 21 (latitude 59.5716612°, longitude 120°), Point 15 (latitude 40.340891453°, longitude 150°), and Point 6 (latitude 0°, longitude 168°); again by a small circle line segment passing through Point 2 (latitude 0°, longitude 48°), Point 13 (latitude 40.340891453°, longitude 30°), Point 19 (latitude 59.5716612°, longitude 0°), Point 24 (latitude 59.5716612°, longitude 300°), Point 17 (latitude 40.340891453°, longitude 270°), and Point 9 (latitude 0°, longitude 252°); again by a small circle line segment passing through Point 3 (latitude 0°, longitude 72°), Point 14 (latitude 40.340891453°, longitude 90°), Point 21 (latitude 59.5716612°, longitude 120°), Point 22 (latitude 59.5716612°, longitude 180°), Point 16 (latitude 40.340891453°, longitude 210°), and Point 8 (latitude 0°, longitude 228°); again by a small circle line segment passing through Point 4 (latitude 0°, longitude 108°), Point 14 (latitude 40.340891453°, longitude 90°), Point 20 (latitude 59.5716612°, longitude 60°), Point 19 (latitude 59.5716612°, longitude 0°), Point 18 (latitude 40.340891453°, longitude 330°), and Point 11 (latitude 0°, longitude 312°); again by a small circle line segment passing through Point 5 (latitude 0°, longitude 132°), Point 15 (latitude 40.340891453°, longitude 150°), Point 22 (latitude 59.5716612°, longitude 180°), Point 23 (latitude 59.5716612°, longitude 240°), Point 17 (latitude 40.340891453°, longitude 270°), and Point 10 (latitude 0°, longitude 288°); again by a small circle line segment passing through Point 7 (latitude 0°, longitude 192°), Point 16 (latitude 40.340891453°, longitude 210°), Point 23 (latitude 59.5716612°, longitude 240°), Point 24 (latitude 59.5716612°, longitude 300°), Point 18 (latitude 40.340891453°, longitude 330°), and Point 12 (latitude 0°, longitude 348°); and again by a line segment which is used as an equator connecting Point 1 (latitude 0°, longitude 12°), Point 3 (latitude 0°, longitude 72°), Point 5 (latitude 0°, longitude 132°), Point 7 (latitude 0°, longitude 192°), Point 9 (latitude 0°, longitude) 252°, Point 11 (latitude 0°, longitude 312°), and Point 1 (latitude 0°, longitude 12°).

2. The golf ball of claim 1, wherein the dimples arranged on a spherical hexagon centered on the pole comprise dimples having the same size only.

3. The golf ball of claim 1, wherein the dimples arranged on a spherical hexagon centered on the pole comprise dimples of two different sizes.

4. The golf ball of claim 1, wherein the dimples are circular dimples.

5. The golf ball of claim 1, wherein the dimples are polygonal dimples.

6. The golf ball of claim 1, wherein the dimples comprise one or more circular dimples and one or more polygonal dimples.

7. The golf ball of claim 4, wherein, sizes of diameters of the dimples include two to eight different sizes.

8. The golf ball of claim 5, wherein the dimples have two to eight types, the types of the dimples being different in one or more of a size, a diameter, and a shape.

9. The golf ball of claim 6, wherein the dimples have two to eight types, the types of the dimples being different in one or more of a size, a diameter, and a shape.

10. A golf ball having dimples arranged in virtual spherical polygons formed by dividing a surface of a sphere using virtual dividing lines, wherein, when there are two hemispheres divided by an equator, and six small circle line segments arranged symmetrically with respect to a pole that is the farthest from the equator, to form a spherical regular hexagon with respect to the pole, each of the six small circle line segments being shorter than half of the length of the equator, wherein the virtual spherical polygons formed on the hemisphere comprise one spherical regular hexagon centered on the pole, six middle spherical isosceles triangles having one side of the spherical regular hexagon as a base, six near-equator spherical isosceles triangles sharing a near-equator vertex with the middle spherical isosceles triangles and having a base on the equator, six spherical pentagons located between the middle spherical isosceles triangles and the near-equator spherical isosceles triangles and having one side on the equator, wherein the two hemispheres are combined with each other by rotating one hemisphere by 30° relative to the other hemisphere with respect to a reference line passing through poles of the two hemispheres and perpendicular to a plane where the equator is located, such that the small circle line segments on one hemisphere are connected to the small circle line segments on the other hemisphere, thereby forming smooth curves.

11. The golf ball of claim 10, wherein the dimples arranged on a spherical hexagon centered on the pole comprise dimples having the same size only.

12. The golf ball of claim 10, wherein the dimples arranged on a spherical hexagon centered on the pole comprise dimples having two different sizes.

13. The golf ball of claim 10, wherein the dimples are circular dimples.

14. The golf ball of claim 10, wherein the dimples are polygonal dimples.

15. The golf ball of claim 10, wherein the dimples comprise one or more circular dimples and one or more polygonal dimples.

16. The golf ball of claim 13, wherein sizes of diameters of the dimples have two to eight different sizes.

17. The golf ball of claim 14, wherein the dimples have two to eight types, the types of the dimples being different in one or more of a size and a shape.

18. The golf ball of claim 15, wherein the dimples have two to eight types, the types of the dimples being different in one or more of a size, a diameter, and a shape.

* * * * *